United States Patent [19]

Bastide

[11] 3,949,694

[45] Apr. 13, 1976

[54] SPECIAL SUBMARINE DEVICES USING A NOVEL INTEGRATED LIFT, PROPULSION AND STEERING SYSTEM

[76] Inventor: Paul Bastide, 108, rue de Rennes, 75006 Paris, France

[22] Filed: Oct. 16, 1974

[21] Appl. No.: 515,684

Related U.S. Application Data

[62] Division of Ser. No. 354,791, April 26, 1973, Pat. No. 3,865,060.

[30] Foreign Application Priority Data

Apr. 26, 1972 France ..... 72.14768

[52] U.S. Cl. ..... 114/16 R; 115/52

[51] Int. Cl.[2] ..... B63G 8/16

[58] Field of Search ..... 114/16 R, 16 F, 16.4, 16.8, 114/50, 151, 126, 122; 61/69 R, 69 A; 115/50, 52, 39, 1 R; 416/111, 108, 109, 110; 244/12 A

[56] References Cited

UNITED STATES PATENTS

| | | | |
|---|---|---|---|
| 947,921 | 2/1910 | Lake | 61/69 A |
| 1,192,546 | 7/1916 | Murphy | 114/16 F |
| 1,740,820 | 12/1929 | Kirsten | 115/52 |
| 1,814,689 | 7/1931 | Grieshaber | 114/16.8 |
| 1,922,606 | 8/1933 | Voith | 115/50 |
| 2,077,477 | 4/1937 | Hellman | 114/16.8 |
| 2,155,456 | 4/1939 | Steinen | 114/122 |
| 2,190,617 | 2/1940 | Steinen | 114/122 |
| 2,210,935 | 8/1940 | Giliberty | 114/126 |
| 2,214,656 | 9/1940 | Briggs | 114/16 R |
| 2,250,772 | 7/1941 | Mueller et al. | 115/52 |
| 2,291,940 | 8/1942 | Babcoke | 114/16 R |
| 2,448,075 | 8/1948 | Bortner | 114/126 |
| 2,455,048 | 11/1948 | Du Brie | 115/1 R |
| 3,045,630 | 7/1962 | Foll et al. | 114/122 |
| 3,165,280 | 1/1965 | Shao-Tanglee | 244/12 A |
| 3,356,055 | 12/1967 | Link | 114/16 R |
| 3,434,443 | 3/1969 | Estabrook | 114/50 |
| 3,704,961 | 12/1972 | Fork et al. | 416/111 |

*Primary Examiner*—Trygve M. Blix
*Assistant Examiner*—Galen L. Barefoot
*Attorney, Agent, or Firm*—Haseltine, Lake & Waters

[57] ABSTRACT

A submarine device having a hull which is substantially symmetrical about a horizontal plane of symmetry and vertical longitudinal and transverse planes of symmetry. An integrated lift, propulsion and steering system is provided for the submarine device and comprises four conventional cycloidal propeller mechanisms in an arrangement in which two are mounted at the front of the hull and two at the rear, the two at the front being rotatable about a common transverse horizontal axis disposed below the horizontal plane of symmetry whereas the two at the rear are rotatable about a common transverse axis disposed above the horizontal plane of symmetry of the hull. Four auxiliary screws, rotatable about horizontal axes, can be arranged in pairs on the horizontal and vertical planes of symmetry respectively, the auxiliary screws having reversible blades and being capable of turning to produce vertical thrust.

8 Claims, 7 Drawing Figures

PL I-3

PL.II_3

PL III_3

SPECIAL SUBMARINE DEVICES USING A NOVEL INTEGRATED LIFT, PROPULSION AND STEERING SYSTEM

CROSS-RELATED APPLICATION

This Application is a division of co-pending application Ser. No. 354,791 filed Apr. 26, 1973 and now issued as U.S. Pat. No. 3,865,060. The Application is also related to Ser. No. 498,873 filed Aug. 19, 1974 which in turn is a division of Ser. No. 354,797 filed Apr. 26, 1973 now abandoned.

BRIEF SUMMARY OF THE INVENTION

The present invention relates to a novel submarine device capable of utilization with improved prospect in important fields, especially oceanology, with increased safety.

More precisely, the invention is directed to an underwater device capable of executing all kinds of movements, some of which are impossible with a standard submarine, for example, rapid turning in place, translational movements perpendicular to the longitudinal centerline, rapid movements straight upward and downward, and the like. The submarine device has numerous components analogous to those of a standard, conventional submarine, such as a thick-section hull, watertight seal devices for the shafts of various apparatus where they emerge from the thick-section hull, diving ballast tanks, electrical storage batteries for naviation when submerged, compressed air and air conditioning installations. This submarine device, however, differs from a conventional submarine, particularly in the fact that instead of two lateral propellers it is either devoid of a central propeller or it has a single, central propeller and that it dispenses with the stabilizers i.e. the diving rudders as well as the four conventional horizontal-shaft aft rudders (one pair forward, one pair aft).

For these purposes, the submarine device according to the invention uses a novel integrated lift, propulsion and steering system composed of at least one horizontal-shaft cycloidal propeller with a flat circular crown rim with horizontal shaft, carrying at its periphery a circular array of identical horizontal blades, each rotatable around a shaft perpendicular to the rim, under the action of the connecting rod extending parallel to the plane of the rim, all of the connecting rods having a common control head which can be eccentric relative to the axis of rotation of the propeller.

According to another characteristic feature of the invention, the submarine device comprises four cycloidal propellers arranged for rotation about horizontal axes and grouped in twos (one pair forward and one pair aft).

According to a further characteristic feature of the invention, the two pairs of cycloidal propellers fore and aft are symmetrical relative to the center of symmetry of the device, the forward pair being below the horizontal axis of symmetry while the aft pair is above this axis, the two propellers of the same pair being coaxial and symmetrical relative to the longitudinal vertical plane of symmetry, all axes of rotation of the four propellers turning in the same direction as seen by an observer stationed laterally relative to the device.

According to a still further characteristic feature of the invention, the submarine device utilizes, in addition to the four cycloidal propellers, a system of four auxiliary screws with adjustable, reversible blades each having an axis perpendicular to the longitudinal vertical plane of symmetry $xOz$, and suspended from suitably streamlined cross members inside four apertures, two on the longitudinal horizontal axis of symmetry Ox (fore and aft) and two on the transverse vertical axis of symmetry Oz at the top and bottom of the submarine device, the two screws fore and aft each being capable of turning with the support therefor through an angle of 90° around the $Ox$ axis under the action of two circular hydraulic jacks within the device, in order to make vertical (in upwards or downwards direction) the thrust of the two corresponding screws which can thus participate in the purely vertical displacement.

BRIEF DESCRIPTION OF THE DRAWING

Several embodiments of the invention will be described below with reference to the annexed drawings wherein.

DETAILED DESCRIPTION

In the following description, the three conventional principal spatial coordinate axes will be employed, Ox being in the direction of forward movement of the submarine device horizontally, Oy the transverse horizontal axis, and Oz the vertical axis.

Figure 1:
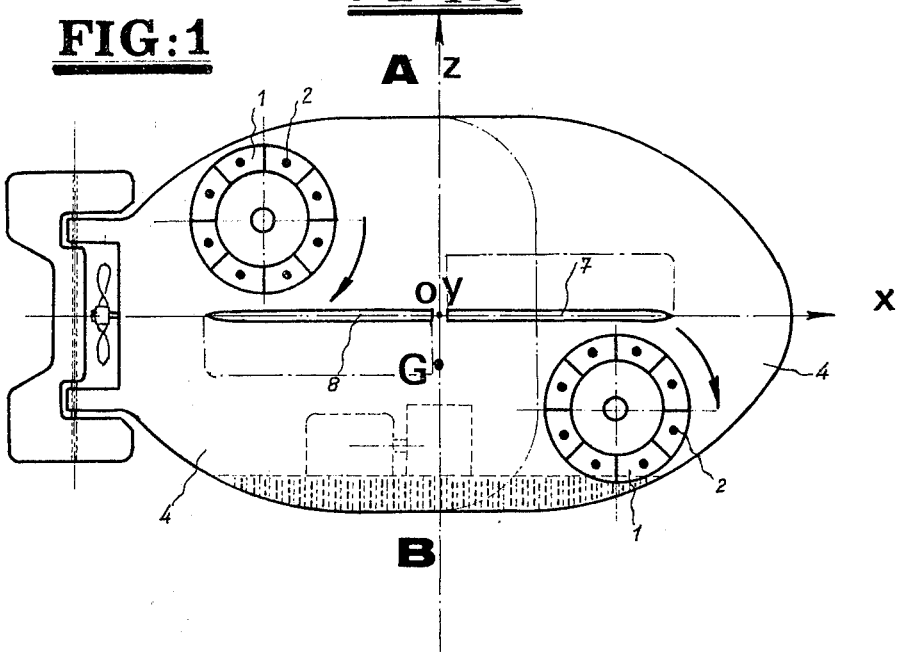
FIG. 1 is a side elevational view of a submarine device according to the invention wherein two pairs of lift propellers are provided for and aft and are staggered in height.
Figure 2:
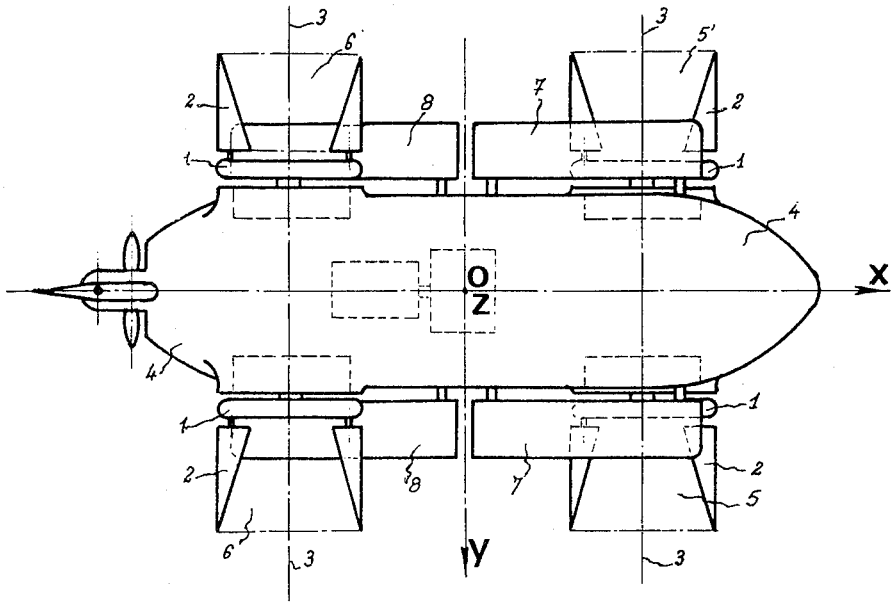
FIG. 2 is a plan view from above of the device in FIG. 1.

With reference to FIGS. 1 and 2, the submarine device comprises a main body 4 having a vertical longitudinal section (in the $xOz$ plane) of oval shape flatter along the vertical axis Oz, and a horizontal longitudinal section (in the $xOy$ plane) also oval but more tapered along the horizontal axis $Ox$. The point O is a general point of symmetry for the entire surface of body 4, i.e., this surface has three principal planes of symmetry; $xOy$, $xOy$ and $yOz$. It follows, in particular, that for purely vertical displacement (which cannot be achieved by a conventional submarine) the flow of water around this surface, assumed for the time being to be linear and without appendage, is symmetrical about the Oz axis, and for horizontal displacement along axis $Ox$, the flow is symmetrical about the $Ox$ axis.

The submarine device can be simultaneously propelled and, if need be, assisted in its normal lift (by means of the side ballast tanks) by four identical cycloidal propellers distributed in pairs, one pair 5, 5′ fore, the other pair 6, 6′ aft, all of whose axes of rotation are perpendicular to the $xOz$ plane. The pairs of propellers 5, 6'; and 5 and 6' are spaced as far as possible from each other in order to avoid my serious interaction, the two propellers in a particular pair being symmetrical relative to the general plane of symmetry.

These cycloidal propellers, sometimes called "Voight-Schneider propellers," comprise a circular flat rim 1 carrying at its periphery a uniform circular array of identical blades 2, each rotatable around an axis perpendicular to the rim 1, under the operation of a jointed connecting rod (see FIG. 5) parallel to the plane of the said rim, all of said jointed connecting rods having a common control head which may be eccentric relative to the axis of rotation 3 of the propeller assembly. When the position of the common control head of these jointed connecting rods is staggered under the action of a mechanical or hydraulic drive operated by the pilot, the total thrust p of the propeller always stays in one particular plane perpendicular to the axis of rotation 3 which is horizontal here, and its direction can turn at will through 360° in that plane.

Consequently, for the sake of simplification also, we shall designate by the term "VSH device" the cycloidal horizontal-shaft propeller which will be used in the submarine device.

The axis of rotation 3 common to the two propellers of the forward pair is so placed that the top of each of these two propellers is located a little below the plane $xOy$; the axis of rotation 3 of the aft pair is symmetrical relative to the point O with that of the forward pair so that the bottom of each of the propellers of the aft pair is located slightly above the $xOy$ plane. The object of this arrangement is to separate as sharply as possible the water flow regions around the two propellers fore and aft of each side, in order to obviate any interaction between these two propellers. For the same reason, this arrangement is completed on each side by the provision of a horizontal fin composed of respective sections 7, 8 located in the $xOy$ plane. The fin has a length such that its opposite ends extend beyond the vertical planes respectively containing the axis of rotation 3 of the forward pair and the axis of rotation of the aft pair. The sections 7, 8 of each fin are identically equal, the forward section 7 being folded upward to assume a vertical position on vertical displacement of the submarine device, the aft section 8 then being folded vertically downward. The folded position of the sections at the time of vertical displacement is shown in dotted outline in FIG. 1. All the VSH devices 5, 5', 6 and 6' rotate in the same direction as seen by an observer facing the submarine device on the Oy axis.

Figure 4:
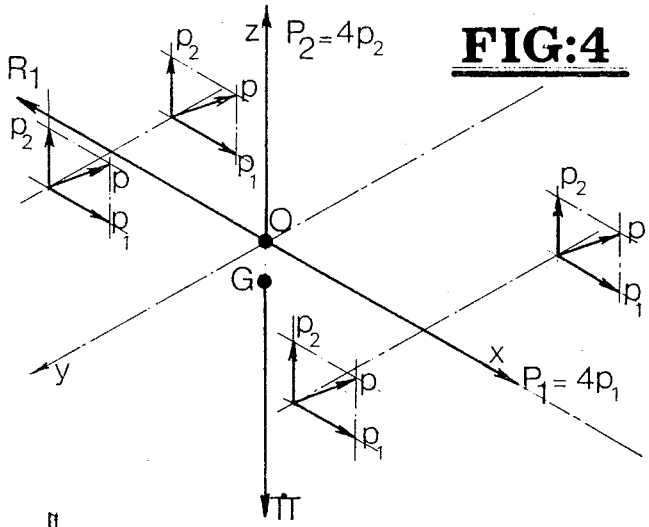
FIG. 4 diagrammatically illustrates the forces capable of acting on the submarine device merely by the lifting propeller devices with which it is equipped, and optionally in addition with its conventional aft screw.

FIG. 4 shows the resolution of the thrusts p of each VSH device the horizontal thrust components $p_1$ and into vertical thrust components $p_2$ such that, (assuming the conventional rear screw is not operating) the horizontal resultant $P_1 = 4\ p_1$ balances the hydrodynamic reaction $R_1$ and the vertical resultant $P_2 = 4\ p_2$ balances the apparent weight $\pi$ of the submarine device (i.e. the difference between its actual weight and the buoyancy).

On vertical displacement of the submarine device, the four VSH devices are regulated so that their thrusts shall be at their maximum values p, equal among themselves, vertically upward, each applied on the axis 3 of the corresponding propeller, and they are added together to give the total thrust $p = 4\ p$, vertically upward at the point O.

Such total thrust P has the capability of appreciably exceeding the apparent weight $\pi$ of the submarine device (acting vertical downward at the center of gravity G of the submarine device i.e. passing through O) whereupon the submarine device will rise vertically.

This total vertical thrust P can slso be directed downward with an intensity greater and opposite to the buoyancy (Archimedean thrust) whereupon the submarine device submerges vertically in the water.

This vertical resultant thrust P of the four VSH devices can also be made exactly equal to the apparatus weight $\pi$, whereupon the submarine device will remain at a given level in place.

The thrusts supplied by the four VSH devices can also effect horizontal displacement of the submarine device, in addition to the thrust supplied by the aft screw.

When held at a fixed level, the submarine device can be simply revolved around the vertical through its center of gravity G, i.e. the Oz axis, by increasing and inclining toward the forward horizontal the thrusts of the two devices located opposite the side toward which it is desired to turn the nose of the submarine device, and likewise regulating but inclined toward the rear horizontal the thrusts of the two propellers located on the other side, which leads to the application on the submarine device of a pure torque around the vertical axis passing through the center of gravity G.

For steering the submarine device around each of the principal axes $Ox$, $Oy$, $Oz$, the system of the four VSH devices can give great capability for handling through differentiation of the directions of the thrusts of each of the four VSH devices.

Figure 3:
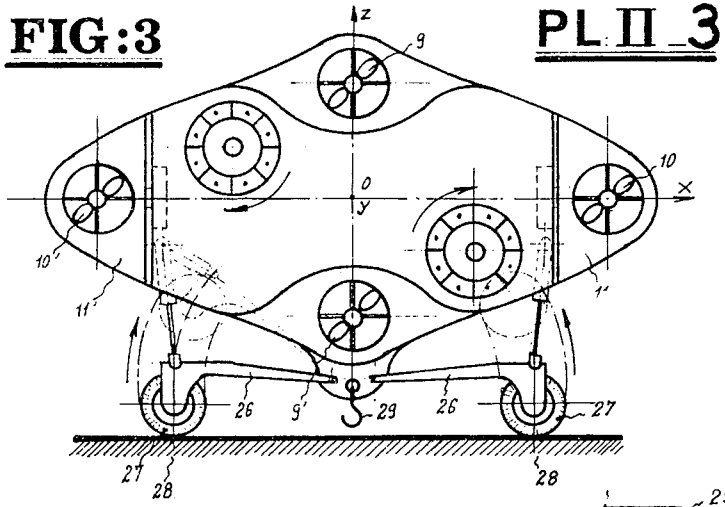
FIG. 3 is a side elevational view of a submarine device according to FIGS. 1 and 2 but provided with reversible-blade screws instead of conventional devices.

According to another embodiment of the invention shown in FIG. 3, the torque around the Ox axis can be regulated by two screws 9 and 9' having rotatable, reversible blades, with transverse horizontal axes perpendicular to the Oz axis symmetrically related to O, each screw being suspended with its electric driving motor inside a circular aperture by a suitably streamlined cross member (FIG. 3). The torque around the Oz axis will likewise be regulable by two screws 10 and 10' with rotatable, reversible blades on transverse horizontal axes perpendicular to the $Ox$ axis symmetrically related to O, each screw being housed in fore and aft portions of the submarine device (FIG. 3).

This arrangement offers the following three advantages: first, by directing the equal transverse thrusts of the two fore and aft screws 10 and 10' in opposite directions from each other, a supplementary means becomes available for rotating the submarine device around its vertical axis of symmetry Oz; second, by directing the thrusts of the four screws 9, 9', 10 and 10' in the same direction, a means is provided (not furnished by any conventional submarine) for displacing the submarine device by simple translation along a transverse axis parallel to the $Oy$ axis; finally, by providing that each of the fore and aft portions of the device, 11 and 11', can revolve through 90° under the action of a hydraulic circular jack around an axis coincident with the Ox axis, the axes of the two corresponding screws 10 and 10' can be made vertical allowing them also to be used in assisting rapid vertical displacement of the submarine device, upon or downward (a matter impossible of realization with a conventional submarine).

Of course, it is possible to make the steering and stabilization of the submarine device automatic, according to conventional means, by controlling each of the devices which have just been described, for example, to control the angle which the real vertical (as determined by a gyroscope) makes with each of the spatial coordinate axes Ox, Oy and Oz.

The power required for operating the various motor devices described above (the conventional screws, the four VSH propellers, the four screws with rotatable blades) each having a respective driving motor (watertight motor for the engines of the four screws) is supplied in accordance with conventional arrangements for known submarines, namely: for surface navigation or with snorkel apparatus, a diesel engine driving a common electric generation set, and a common set of storage batteries for navigation when submerged.

Figure 5:
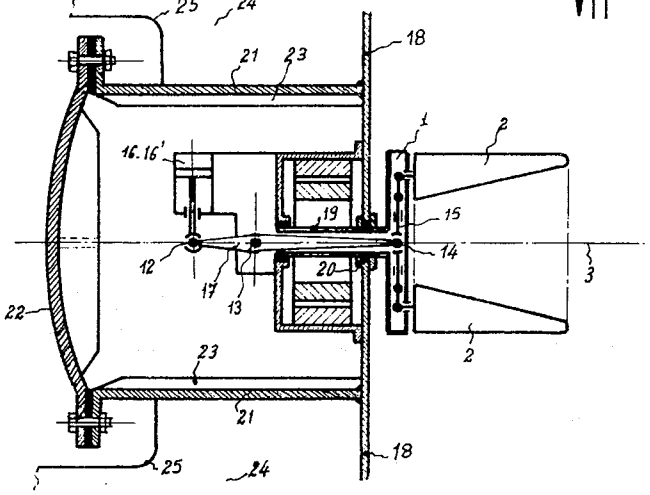
FIG. 5 is a vertical section through the control device for the connecting rods for rotation of the blades of each of the four porpeller devices.

FIG. 5 diagrammatically illustrates the assembly of each VSH device, and therein can be seen an electric driving motor mounted inside the ballast tank wall and a generally known mechanism for controlling the tilt of the control head for the jointed connecting rods of each VSH device. This mechanism is composed of two hydraulic presses mounted at 90° from each other (of which only one is illustrated for purposes of clarity) and acting on the known device having three joints 12, 13 and 14, the middle joint 13 being fixed and the other two movable, the joint 14, controlling the position of jointed rod 15 in accordance with a well known principle of kinematics (with straight lever, jointed lever or actuating lever) said jointed rods being contained in the rim 1 and each acting on one blade 2.

The two presses 16 and 16' are fixed as is the middle joint 13 and they are physically fastened to the outside shell of the electric driving motor for the VSH propeller, the lever 17 controlling the movement of the third articulation joint 14 being housed inside the shaft 19 joining the rotor of the electric motor to the rim of the VSH propeller, said shaft being hollow. Obviously, the adaptation of the horizontal-shaft VSH propellers is highly advantageous as compared to vertical-shaft propellers which were exclusively adopted heretofore.

In particular, with the horizontal-shaft VSH device, control of the orientation of the blades (while preserving the same principle of three swivel joints) is positive and much simpler than the current conventional control of the vertical-shaft devices used hitherto (which require for the control of the three swivel joint device a horizontal drive shaft from the motor, with a complicated and expensive device of bevel gear type to change the direction of the propeller driving shaft through 90° to make it vertical).

The electric driving motor for the VSH propeller, the two hydraulic presses 16 and 16', and also the device with three articulation joints 12, 13 and 14, are fastened to the inside wall 18 of a diving ballast tank, the hollow shaft 19 between the electric motor and the VSH device passing through said wall with a watertight joint 20. The above assembly is located inside a hollow cylinder 21, closed by the watertight port 22, and its walls are internally reinforced by a series of stiffeners 23 located at regular angular intervals.

To strengthen the attachment of the hollow cylinder 21 to the wall 18 of the ballast tank, the transverse bulkhead 24, appropriately cut away at 25 to allow opening of the watertight port 22, at the same time connects the thick shell of the hull to the wall 18 of the ballast tank and to the wall of the hollow cylinder 21.

Finally, FIG. 3 illustrates a retractable support means with four arms 26 arranged in symmetrical pairs relative to the xOz and yOz planes and so mounted that in the position of rest or for landing, the vertical through the center of gravity of the submarine device falls at the center of the rectangle determined by the four wheels 27. These wheels each rotate around a horizontal axis and are also capable of revolving about a vertical axis 23 so as to permit the submarine device to pivot in place on the ground.

Finally, the submarine device can be equipped at its lower middle portion on the Oz axis with a very sturdy hook 29 rotatable on an axis coincident with the Oz axis for carrying loads which can be considerable.

The novel types of submarine device according to the present invention provides at least four principal advantages as compared to contemporary conventional submarines:

First, they are much easier to handle, in particular with the possibilities in the water as on land, of rotation in place around their vertical axis of symmetry and of pure translation perpendicularly to their longitudinal plane of symmetry, whereas the handling of a conventional submarine requires the submarine to have a minimum forward speed so as to make useful operation of the controls (rubber and fore and aft diving planes);

Second, they can have powerful means for quick absolutely vertical submersion and resurfacing (whereas conventional submarines can do this only stage by stage), by reason of the four lateral VSH propellers being able to impart a powerful thrust for rapid vertical submersion and rapid vertical resurfacing;

They can also, all things being equal, lift and carry under water and deposit on the sea bottom and on ground substantially greater weights because of the capability of strong upward and downward thrusts produced by the four VSH devices;

Finally, even if for any reason at all the buoyancy, properly so called, of the submarine device according to the present invention becomes negative, it can to a very great extent be counterbalanced by the considerable vertical upward thrust which can be furnished by the four VSH devices, whereas in such circumstance, all things otherwise being equal, a conventional type submarine would only have much less efficacious means for saving itself.

By reason of the aforementioned advantages, submarine devices in accordance with the invention allow various submarine operations to be effected, especially as principal adjuncts to oceanological tasks, below the water surface, on the ocean bottom and on land, especially as inspection and repair vessels for immersed hulls and bottoms of large surface ships, as mobile hoisting platforms for safe submersion, lifting and movement of even heavy loads which will be required for all tasks in ocean depths and on ground, and as "taxis" and "trucks" to ensure quick vertical shuttling of personnel and material between the surface and the ocean bottom, this being effected with ease and with greater safety than can be obtained with conventional type submarines or any other submarine currently known.

Finally, the present invention contemplates that a four-VSH propeller submarine device of the type shown in FIG. 1 can be coupled to an inert underwater craft equipped with auxilliary screws and ballast tanks capable, when empty, of lifting the device with its whole load, the inner hull of such craft being, either of the open type (cross section of FIG. 6) for the conveyance of various solid materials or of the closed type such as the thick hull of a standard submarine this latter being used for the conveyance of a liquid load (oil, for example).

Figures 6, 6A:
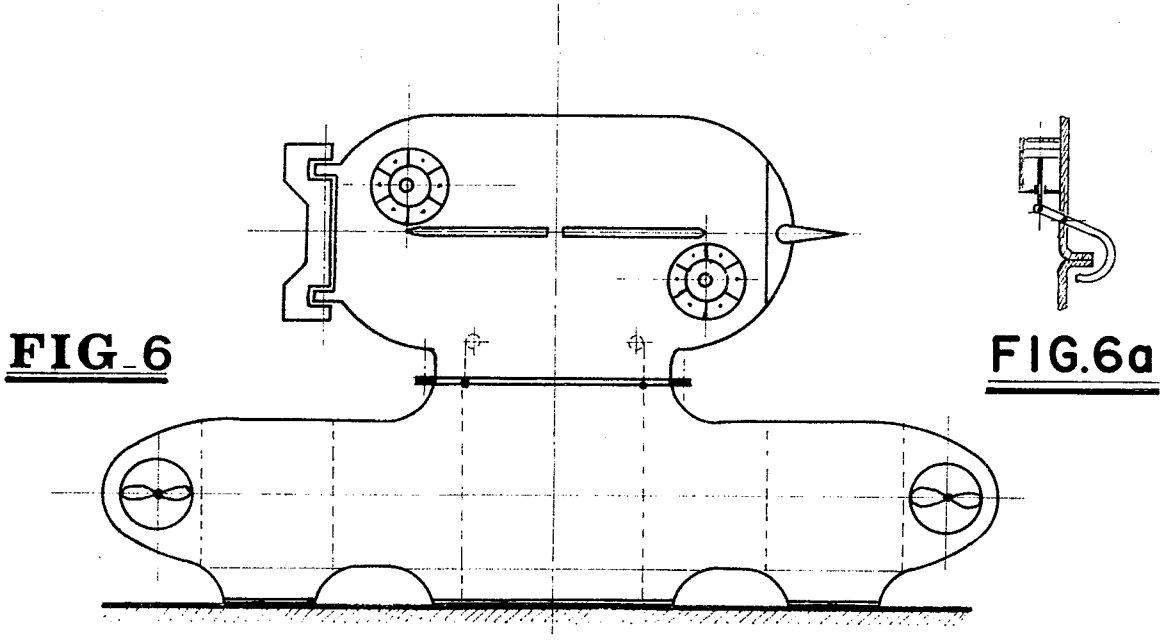
FIG. 6 diagrammatically illustrates the coupling of the submarine propeller device of FIG. 1, with a propeller less inert submersible vessel.
FIG. 6*a* illustrates the linking means of FIG. 6.

The linking of inert underwater craft with the propeller device is effected as shown in FIG. 6 by lateral and transverse hooks 30 (FIG. 6*a*) driven by hydraulic jacks for rapid operation.

What is claimed is:

1. A submarine device capable of perpendicular translation relative to its longitudinal axis inclusive of purely upward and downward movements using an integrated system of lift, propulsion and steering, said submarine device comprising a hull with a center of symmetry and vertical and horizontal planes of symmetry passing through said center, said integrated system comprising four cycloidal propellers grouped in pairs, one pair being forward on said hull and one pair aft on said hull, each cycloidal propeller having a horizontal axis of rotation and including a flat circular rim carrying at its periphery a circular array of identical horizontal blades each rotatable about a horizontal axis perpendicular to the said rim, means for rotating the blades about their axes including a jointed connecting rod for each blade extending parallel to the plane of said rim, a master control head coupled to said rods and capable of being staggered relative to the axis of rotation of said propeller, said two pairs of cycloidal propellers being symmetrically arranged relative to said center symmetry of the hull, the forward pair being lower and the aft pair higher, the two propellers of each pair being coaxial and symmetrical relative to the longitudinal vertical plane of symmetry of the hull, the directions of rotation of the propellers on each side of the hull being the same, four auxiliary screws suspended from said hull and having rotatable and reversible blades with axes of rotation perpendicular to the longitudinal vertical plane of symmetry, two of said auxiliary screws being on the longitudinal horizontal axis of symmetry one forward and one aft and two on the transverse vertical axis of symmetry one above and the other below the horizontal plane of symmetry, the two screws on the longitudinal axes each being able to turn through 90° around the longitudinal horizontal axis to produce vertical thrust to assist in purely vertical displacement of the submarine device.

2. A submarine device as claimed in claim 1 comprising individual electric motors inside the hull for driving the four propellers and the four auxiliary screws.

3. A submarine device as claimed in claim 2 comprising a diving ballast tank, each propeller and the corresponding mechanism for rotation of the jointed connecting rods being located inside said ballast tank and secured to the inside wall thereof, a propeller driving shaft for the propeller passing through said wall of said tank with a watertight joint, said shaft being hollow, and a common lever in said shaft for actuating the connecting rods to causing rotation of the jointed connecting rods.

4. A submarine device as claimed in claim 2, a cylinder with a watertight port, secured in said hull and accommodating the electric driving motor for each propeller as well as the mechanism for rotating the jointed connecting rods, a set of stiffeners placed at regular angular intervals within said cylinder parallel to the axis thereof and a transverse bulkhead joining the hull simultaneously to the ballast tank and to said cylinder, the said transverse bulkhead being in a plane containing the cylinder axis.

5. A submarine device capable of perpendicular translation relative to its longitudinal axis inclusive of purely upward and downward movements using an integrated system of lift, propulsion and steering, said submarine device comprising a hull with a center of symmetry and vertical and horizontal planes of symmetry passing through said center, said integrated system comprising four cycloidal propellers grouped in pairs, one pair being forward on said hull and one pair aft on said hull, each cycloidal propeller having a horizontal axis of rotation and including means for adjusting the direction of net thrust produced by each cycloidal propeller in a vertical plane perpendicular to said horizontal axis of rotation, said two pairs of cyloidal propellers being symmetrically arranged relative to said center of symmetry of the hull, the forward pair being lower and the aft pair higher, the two propellers of each pair being coaxial and symmetrical relative to the longitudinal vertical plane of symmetry of the hull, the directions of rotation on each side of the hull being the same, two pairs of auxiliary screws suspended from said hull and having rotatable and reversible blades with axes of rotation perpendicular to the longitudinal vertical plane of symmetry, one pair of said auxiliary screws being on the longitudinal horizontal axis of symmetry and the second of said pairs being on the transverse vertical axis of symmetry offset from the horizontal plane of symmetry, the screws on the longitudinal axis being able to turn though 90° around the longitudinal axis to produce vertical thrust to assist in vertical displacement of the submarine device.

6. A submarine device as claimed in claim 5, wherein the hull is of oval shape, flattened along the longitudinal axis in the vertical plane of symmetry and more tapered in the horizontal plane of symmetry.

7. A submarine device as claimed in claim 5 comprising a support including four retractable feet, and a wheel supported from each foot, said feet being symmetrical relative to the longitudinal and transverse planes of symmetry, the wheel corresponding to each foot being supported for rotation around a horizontal axis and also around a vertical axis to allow turning in place of the submarine device.

8. A submarine device as claimed in claim 5 comprising a hook supported from said hull at the bottom thereof on a vertical line passing through the center of gravity of the hull for carrying loads, said hook being rotatable about a vertical axis.

* * * * *